United States Patent [19]

Regamey

[11] 4,065,056

[45] Dec. 27, 1977

[54] METHOD AND DEVICE FOR THERMALLY CONTROLLING A UTILIZATION UNIT FED BY A CONDENSABLE VAPOR DISTRIBUTING SYSTEM

[76] Inventor: Pierre Eugene Regamey, 33 Plein Soleil, 42580 L'Etrat, France

[21] Appl. No.: 641,016

[22] Filed: Dec. 15, 1975

[30] Foreign Application Priority Data

Dec. 16, 1974 France ..... 74.41374

[51] Int. Cl.[2] ..... F24D 1/08

[52] U.S. Cl. ..... 237/67; 60/654; 60/691; 60/692

[58] Field of Search ..... 237/67, 9 R, 74; 60/690–692, 654; 122/1 R

[56] References Cited

U.S. PATENT DOCUMENTS

| | | | |
|---|---|---|---|
| 1,988,382 | 1/1935 | Greene | 237/67 |
| 2,131,901 | 10/1938 | Parkton | 237/67 |
| 3,108,575 | 10/1963 | Martinuzzi | 122/1 R |
| 3,913,835 | 10/1975 | O'Brien | 237/67 |
| 3,940,058 | 2/1976 | Norris | 237/67 X |

*Primary Examiner*—William E. Wayner
*Assistant Examiner*—William E. Tapolcai, Jr.
*Attorney, Agent, or Firm*—Haseltine, Lake & Waters

[57] ABSTRACT

A method for thermally controlling a utilization apparatus heated with condensable steam, mounted in a live steam distribution plant comprising a condensate drain line system for dry gravity return of the condensates which also contains live steam, said method consisting in a selectively variable storage of the condensates through modulated retention within said utilization apparatus, wherein the improvement comprises the step of preventing the collected condensates which are cooled through retention thereof from directly contacting the hot live steam present in said condensate drain line system.

16 Claims, 3 Drawing Figures

1
2
3
4
5
6
7
8
9a
10
11
12
13
14
15
19

1
2
3
4
5
6
7
8
9b
17
18

1
2
3
4
5
5'
6
7
8
9
10
11
12
13
14
15
16
18
19

METHOD AND DEVICE FOR THERMALLY CONTROLLING A UTILIZATION UNIT FED BY A CONDENSABLE VAPOR DISTRIBUTING SYSTEM

The present invention is generally concerned with and essentially relates to a method of thermally controlling a utilization apparatus fed by a condensable live vapour distributing system and a device for carrying out this method as well as the various applications and uses resulting from putting them into practice and the assemblies, arrangements or appliances, equipments and plants provided with such devices.

The invention relates in particular to the thermal control of units using, absorbing or consuming a heat-conveying fluid in condensable gaseous condition such in particular as a vapour (for instance steam forming an outstanding heat-conveying medium) and such a vapour-receiving utilization or working unit may provide in particular a heat generator for producing or evolving heat through phase transformation or equivalent change in the physical state of the heat-conveying fluid forming for instance a heating medium for heating or heat transfer purposes. The utilization unit often exhibits a heat exchanging surface or wall means forming for instance either a heating body such as a unit heater, radiator, convector, heating panel, finned tube, air or space heater, condenser or the like or a heat exchanger with thoroughfare flow passageways or paths for at least one hot or heating fluid to be cooled down and for at least one cold or cooling fluid to be heated up. In such a utilization apparatus the heating for instance saturated vapour or steam gives up its heat therein through condensation to liquid on the heat-exchanging wall thereby resulting in heat emission. The utilization unit is generally mounted in a live steam or vapour distributing plant arranged as at least one closed loop wherein the fluid temperature and pressure are substantially constant or invariable and the same everywhere throughout the circuit system except for head or pressure and heat losses, said system comprising at least one live steam supply line system and at least one dry return line system for condensates (drained off through natural gravity flow) also containing live steam in the absence of any steam-trap, condensed liquid bleeder or like phase separator, said utilization unit being connected with at least one steam inlet and with at least one condensate outlet, respectively, by means of steam feed and condensate drain branch pipes, respectively, to at least two steam supply and condensate return ducts or mains, respectively, forming part of the steam supply line system and of the condensate return line system, respectively.

In the case in particular of a utilization unit indirectly heated by condensable vapour or steam and with selectively variable operating output characteristics or heat emission such as in particular a heat exchanger or the like, there is known in the prior state of the art a process for controlling such a heat exchanger through steam wire-drawing at the inlet of the heat exchanger for instance by means of a globe or screw-down valve or the like manually or automatically operated according to the temperature of the heated fluid and connected in the steam feed duct: such an adjustment may sometimes also be carried out by means of a two position or on-off appliance when variations may be accepted in the temperature of the heated fluid. Another known process consists in effecting the aforesaid control through a control member such as a for instance automatically operated cock, valve or gate which is not located upstream on the steam feed duct at the inlet of the heat exchanger but downstream on the condensate-drain duct at the outlet of the heat exchanger. This second process is in particular advantageous when the operation of the heat exchanger is substantially stable, i.e. when the flow rate, the physical characteristics or properties and the temperatures of the fluid are nearly constant. In such a case at least the bottom or lower part of the heat exchanger is then flooded within a more or less substantial height of condensed liquid according to the degree of opening of the control valve or cock which thereby enables to collect a selectively variable amount or storage of condensates by holding or keeping same back in a modulated fashion within the utilization unit or heat exchanger which thereby varies the usable dry surface for the heat exchange or heat power generation. This latter process is advantageous in particular because it enables to achieve on the one hand installation savings and on the other hand an improvement in the operation. The installation savings are due to the fact that the control cock or valve to be mounted on the condensate drain duct is of smaller diameter than the one which would be required on the steam feed duct and moreover owing to the fact of the removal or absence of any condensate trap or bleeder and its accessories. The improvement in operation is due in particular to the absence of any trap or bleeder (the working of which is sometimes defective or faulty); the amount of sealing condensed liquid left within the utilization unit would prevent any steam escape or leak and the condensates are discharged or forced away at a substantially constant pressure (unlike what happens in the case of a steam intake control). This principle of controlling the heat emission or transfer from a utilization apparatus or heat exchanger through selectively adjustable variation in the dry useful heat exchange or transfer surface is particularly advantageous especially in the case of an unlimited presence of live steam in the aforesaid condensate drain line system.

This known method of control effective by holding the condensates back within the utilization unit in a modulated fashion however exhibits various inconveniences. Thus in the absence of any need for or consumption of heat and accordingly of any want of heat power generation the induced or desired holding back of the condensates results in a collection thereof as a stored amount which may correspond to the total bulk or condensate holding capacity of the utilization unit the heat exchange surface of which is thus fully flooded. This extended stop or discontinuation of the heat consumption may cause the condensates to be cooled down by lowering their temperature down to a value which is significantly lower than that of the live steam present within the condensate drain line system. When there is then again a need for or want of heat emission the downstream control contrivance is caused to allow at least one part of the condensates collected or stored within the utilization unit to be drained off and thus to allow these relatively cool condensates to flow down the condensate drain or return piping which also contains some live steam thereby causing the occurence of violent water hammering through sudden steam condensation within the piping and sudden attendant call for or requirement of like make-up steam. Furthermore in the case of a sudden increase in the need or demand for heat emission, the downstream control member would allow a suitable amount of condensates of the utilization unit to be drained off and would therefore increase the dry surface of the latter which is useful for the heat exchange. On the contrary for obtaining the reverse effect, i.e. a sudden decrease in or even an immediate stop of the heat power generation or heat emission from the utilization unit the downstream control member would discontinue draining off the condensates from said unit; however to achieve a stop of the heat emission it would be necessary to fill the utilization unit up with condensates and accordingly to flood the heat exchange surface thereof thereby requiring the condensation of an equal body or amount of steam corresponding to the volume to be filled with liquid. As such a condensation is not instantaneous it would require some time for becoming effective which is reflected by a momentary but undesirable heat emission after having stopped draining off the condensates.

A main object of the invention is to overcome the aforesaid drawbacks by providing a new and improved method for controlling the heat power from the utilization unit which would enable to avoid or prevent the aforesaid water hammering and/or the delay or time-lag in the stop of the heat emission. This technical problem is solved by the method according to the invention which is characterized in that it consists in preventing the condensates collected or stored and cooled down by holding back same from coming into direct contact with the hot live steam present in the aforesaid condensate drain line system so that the cause of the water hammering phenomenon is thus removed.

This result is obtained according to another characterizing feature of the invention by selectively heating up the aforesaid cooled condensates from each aforesaid utilization unit with adjustable heat output characteristics and by keeping the condensates at a temperature approaching that of live steam before conveying them to the aforesaid condensate drain line system.

According to still a further characterizing feature of the invention this heating step may be relatively very fast or substantially instantaneous and may then act upon the continuously or intermittently flowing condensate drain stream out of the aforesaid utilization unit.

According to an alternative embodiment a buffer-amount of condensates drained off from the utilization unit and preferably having a volume at least substantially equal to the maximum condensate capacity or content of said utilization unit is collected and stored and the body of condensates thus collected is gradually or relatively slowly heated up.

Another characterizing feature of the invention consists in using as a heating medium for carrying out this heating step live steam taken from said steam distributing plant or according to still a further characterizing feature of the invention an independent heating medium is used.

Moreover when an aforesaid steam-fed utilization unit has a heat power or thermal operating characteristic which is selectively variable through control of the condensates drain flow rate thereof a delayed stop of the heat emission of such a utilization unit is avoided when the delay or time-lag is due to a temporary extension or continuation of the condensation within said unit by providing according to still another characterizing feature of the invention a systematic control of the steam input flow rate to said utilization unit.

According to still a further alternative embodiment and in accordance with still another characterizing feature of the invention the heat emission of the utilization unit may be modulated by avoiding any condensate retention therein through a simultaneous or synchronized attendant action of the controls of the condensate outgoing and steam incoming flow rates, respectively, thereby to prevent any storage of condensates within said utilization unit. This offers the advantage of also avoiding any undesirable heating through the incoming steam flowing upwards towards the utilization unit through the condensate branch drain duct while circulating therein in the direction opposite to that of the condensate flow.

The invention is also directed to a device for carrying out said method for controlling the operating heat output characteristics of an aforesaid utilization unit connected through at least one condensate drain or outgoing duct to said steam distributing plant, said device being characterized by means associated with this condensate drain or outgoing duct for preventing the relatively cool condensates coming from this utilization unit from directly contacting the live steam contained in said condensate drain line system.

The usual control upon the condensates also exhibits the inconvenience of a rather large inertia and this control may moreover be used only on a largely sized heat exchanger in order to avoid the risk of a full drainage of the heat exchanger which would bring about steam leakages (this risk may possibly be avoided or overcome by the yet relatively expensive use of a double pulse regulator or controller interlocked or keyed simultaneously in follow-up relationship with the temperature of the product and the level of condensed liquid within the heat exchanger). The invention also enables to remove such inconveniences in addition to those already mentioned hereinabove through simple means which therefore may be manufactured or built economically and which work effectively and thus provide a safe hence reliable operation.

The invention will be better understood and further objects, characterizing features, details and advantages thereof will appear more clearly as the following explanatory description proceeds with reference to the accompanying diagrammatic drawings given by way of non-limitative examples only illustrating various presently preferred specific forms of embodiment of the invention and wherein.

Figure 1:
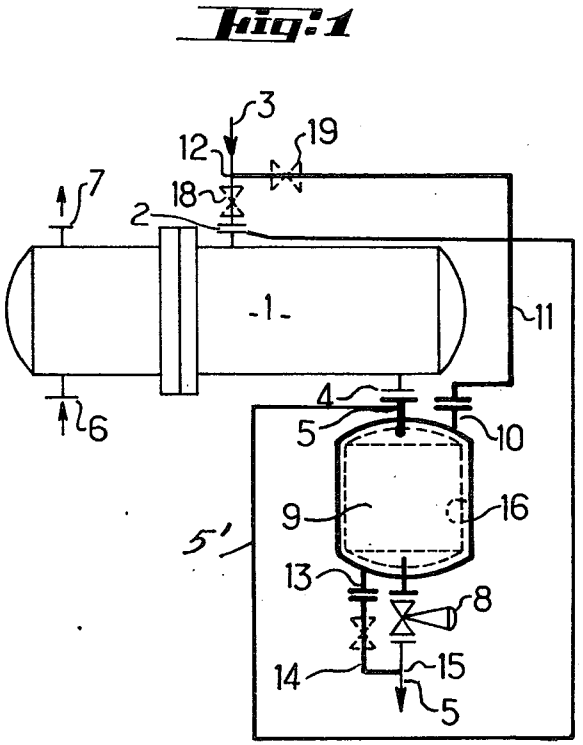
FIG. 1 is an outside view of a utilization unit forming a heat exchanger with selectively adjustable heat transfer and provided at the output with condensate heating means in accordance with a first embodiment.

According to the examplary form of embodiment shown in FIG. 1 the reference numeral 1 generally denotes a utilization appliance in the form of a heat exchanger for instance of the tubular kind with multiple passageways the body or casing of which comprises at its top portion an inlet piping 2 for the incoming steam (forming the hot primary fluid to be cooled down through condensation) connected to a steam feed duct 3 which in turn is branched off a steam supply pipe connected to a steam main or supply line system (not shown) and at its bottom portion at least one outlet piping 4 for the outgoing liquid condensate (forming the cooled fluid) connected to a condensate drain duct 5 which is in turn branched off a condensate return pipe connected to a condensate drain line system (not shown). The circulation box of the heat exchanger 1 comprises at least one inlet piping 6 for the incoming secondary cold or cooling fluid to be heated such as liquid water and at least one outlet piping 7 for the outgoing heated secondary fluid, the circulation of both primary and secondary fluids, respectively, within the heat exchanger 1 being preferably of the counter-flow type, i.e. occurring in opposite directions. (The same reference numerals will denote similar, like or equivalent elements or parts in the various figures of the drawings).

In the outgoing condensate drain duct 5 is fitted a control member 8 for the downstream adjustment of the condensate flow rate as known per se. This control member may consist of a globe or screw-down valve or like for instance automatic control valve operated in the latter case by an associated servo-motor or power actuator the control of which is advantageously keyed in interlocked follow-up relationship to an operating parameter such for instance as the actual temperature of the heated secondary fluid leaving the heat exchanger 1 through the outlet piping 7. A heater unit with a very quick or practically instantaneous action is interposed in series in the outgoing condensate drain duct 5 between the utilization appliance 1 and the control member 8 for heating up practically forthwith or at least within a very short period of time the condensates continuously flowing through said heater unit. Alternatively this heater unit may exert a gradual or relatively slow action and be incorporated into an individual buffer-tank 9 for storing the condensates flowing out of the utilization appliance 1. In such a case the capacity of this buffer-tank is preferably substantially at least equal to the maximum condensate holding capacity of the utilization apparatus 1. The heater unit 9 uses as a heating medium for instance a heating fluid consisting preferably of condensable steam taken advantageously from the incoming steam feed duct 3 and the steam supply and condensate drain circuit of which is accordingly connected in by-passing relationship between the incoming steam feed duct 3 and the outgoing condensate drain duct 5 downstream of the control member 8 provided on the latter. For this purpose the heater unit 9 comprises at its upper portion a heating steam inlet piping 10 branched through a piping 11 off the incoming steam feed duct 3 at a point 12 and at its lower portion a condensate outlet piping 13 branched through a piping 14 off the outgoing condensate drain duct 5 at a point 15 lying after the control member 8. According to the form of embodiment shown in FIG. 1 the heater unit 9 is a vessel with a double-walled heating shell 16 fitted in series in said by-pass circuit between the steam inlet and condensate outlet pipings 10 and 13, respectively.

Figure 2A:
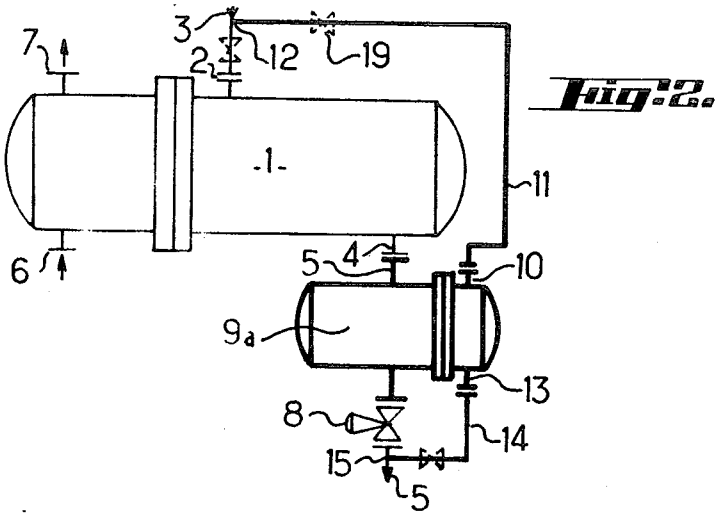
FIG. 2 is a view similar to the preceding one, showing an alternative embodiment of said condensate heating means.

According to an alternative embodiment the vessel 9 provided with a double-walled shell may be replaced by an auxiliary heat exchanger **9*a* as shown in FIG. 2 the heating fluid passageway of which is connected in series through its steam inlet and condensate outlet pipings 10 and 13, respectively, in said by-pass circuit 11, 14 whereas the heated fluid (condensate) passageway is connected in series in the outgoing condensate drain duct 5. According to still another alternative embodiment illustrated in FIG. 3 the heater unit 9*b* is a container provided with an independent heating means 17** such as a tubular coil fed with auxiliary heating fluid, an electrical resistor or any another suitable equivalent means.

A shut-off or adjusting member forming for instance a cut-off cock or control valve 18 may possibly be mounted in the incoming steam feed duct 3 preferably downstream of the branchingoff point 12 for the piping 11 in FIGS. 1 and 2 whereas another shut-off cock or control valve 19 may also be possibly fitted into the steam bleeding piping 11 between the incoming steam feed duct 3 and the heater unit **9, 9*a*** in these figures.

Figure 3:
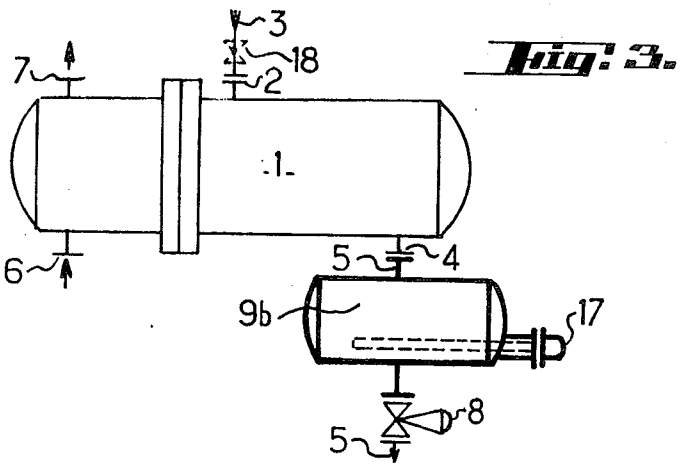
FIG. 3 is a view similar to the preceding ones, showing another alternative embodiment of said condensate heating means.

The three forms of embodiment shown in FIGS. 1, 2 and 3, respectively, enable to prevent the cooled condensates coming from the utilization appliance 1 from contacting the live steam present in the condensate return ducts within the condensate main or drain line systems through previous heating of the condensates.

The provision of flow control members located upstream and downstream of the utilization apparatus, respectively, enables more particularly to avoid any delay or time-lag when stopping the heat emission from the utilization apparatus 1. For this purpose the outgoing condensate drain duct 5 comprises the member 8 for the downstream control of the condensate flow rate and its incoming steam feed duct 3 comprises a member 18 for the upstream control of the steam flow rate; each control member may consist of a preferably automatic control valve operated by a servomotor the actuation of which is keyed in interlocked follow-up relationship to an operating parameter of the utilization appliance 1. The origin of the set points selected for both of these upstream and downstream controls 18 and 8, respectively, may be the same or different so that both valves 18, 8 be keyed in interlocked follow-up relationship either to the same operating parameter or to two respectively distinct operating parameters. The actuation of both control members 18, 8 may thus be either a joint or a separated actuation and their actions may be either simultaneous or synchronized or mutually shifted with respect to each other in time. It is in particular advantageous to provide mutual co-ordination or interacting interlocking follow-up means between both members 8, 18 for controlling the condensate flow rate in the outgoing condensate drain duct 5 on the one hand and the steam flow rate in the incoming stream feed duct 3 on the other hand, respectively, with a view to simultaneously using both of these controls for modulating the heat emission of the utilization appliance 1 while avoiding the retention or storage of condensates therein. The command signal releasing, measuring, pick-up or detecting members for sensing the operating parameters of these controls as well as the control signal emitting relay and pilot members have not been shown in the drawings.

It should be understood that the invention is not at all limited to the forms of embodiment described and shown which have been given by way of examples only. In particular it comprises all the means constituting technical equivalents of the means described as well as their combinations if same are carried out according to its gist and used within the scope of the appended claims.

What is claimed is:

1. A method for thermally controlling a utilization apparatus heated with condensable steam, mounted in a live steam distribution plant comprising a condensate drain line system for dry gravity return of the condensates which also contains live steam, said method consisting in a selectively variable storage of the condensates through modulated retention within said utilization apparatus, wherein the improvement comprises the step of reheating said condensates and permitting said condensates to contact the steam after reheating only.

2. A method for thermally controlling a utilization apparatus heated with condensable steam, mounted in a live steam distribution plant comprising a condensate drain line system for dry gravity return of the condensates which also contains live steam, said method consisting in a selectively variable storage of the condensates through modulated retention within said utilization apparatus, wherein the improvement comprises the step of selectively heating said cooled condensates coming from each aforesaid utilization apparatus with adjustable operating heat output characteristics and keeping them at a temperature approaching that of said live steam before conveying them to said condensate drain line system.

3. A method according to claim 2, comprising an aforesaid relatively quick or substantially instantaneous heating of the stream of flowing condensates drained off said utilization apparatus.

4. A method according to claim 2, comprising the step of collecting and storing a buffer amount of condensates drained off and gradually or relatively slowly heating the body of condensates forming said buffer amount.

5. A method according to claim 2, comprising the step of using an independent heating medium.

6. A method according to claim 2 for an aforesaid utilization apparatus fed with steam and having operating heat output characteristics which are selectively variable through control of the flow rate of the condensates drained away therefrom, characterized by a systematic control of the incoming steam delivery flow rate supplied to said utilization apparatus.

7. A method according to claim 6, including the step of controlling the outgoing condensate drain flow rate and incoming steam feed flow rate, respectively, to avoid any storage of condensates within said utilization apparatus.

8. A device for thermally controlling a utilization apparatus heated with condensable steam with adjustable operating heat output characteristics mounted in a live steam distribution plant including a condensate drain line system for dry gravity return of the condensates which also contains live steam, said apparatus being connected through at least one outgoing condensate drain duct to said steam distributing plant, wherein the improvement comprises means for reheating said condensates and contacting said condensates only after reheating with the steam.

9. A method for thermally controlling a utilization apparatus having an inlet for steam and an outlet for condensates heated with condensable steam, mounted in a live steam distribution plant comprising a condensate drain line system for dry gravity return of the condensates which also contains live steam, said method consisting in a selectively variable storage of the condensates through modulated retention within said utilization apparatus, wherein the improvement comprises the step of using as a heating medium live steam taken from said steam distributing plant to reheat the condensates prior to the return of the condensates to the inlet of the utilization apparatus.

10. A device for thermally controlling a utilization apparatus heated with condensable steam with adjustable operating heat output characteristics mounted in a live steam distribution plant including a condensate drain line system for dry gravity return of the condensates which also contains live steam, said apparatus being connected through at least one outgoing condensate drain duct to said steam distributing plant, wherein the improvement comprises at least one condensate outlet connected to one outgoing condensate drain duct containing a flow rate control member, said device comprising a heater unit with very quick or gradual action interposed in series in said outgoing condensate drain duct between said utilization apparatus and said control member.

11. A device according to claim 10, wherein said heater unit comprises an individual condensate storage buffer-tank.

12. A device according to claim 10, for an aforesaid utilization apparatus with at least one steam inlet connected to an incoming steam feed duct, said device comprising an aforesaid heater unit with heating fluid consisting of condensable steam the steam supply and condensate drain circuit of which is connected in by-passing relationship between said incoming steam feed duct and said outgoing condensate drain duct downstream of said control member provided for the latter.

13. A device according to claim 12, wherein said heater unit is a vessel provided with a double-walled heating shell mounted in series in said by-pass circuit.

14. A device according to claim 12, wherein said heater unit is an auxiliary heat exchanger the heating fluid passageway of which is connected in series in said by-pass circuit.

15. A device according to claim 10, wherein said heater unit is a container provided with an independent self-contained heating means.

16. A device according to claim 10, with a steam flow rate control member interposed in the incoming steam feed duct of said utilization apparatus, characterized by mutual co-ordination or interacting interlocked follow-up means between the condensate flow rate control member in said outgoing condensate drain duct on the one hand and the steam flow rate control member in said incoming feed duct on the other hand, respectively.

* * * * *